US009476349B1

(12) United States Patent
Wells

(10) Patent No.: US 9,476,349 B1
(45) Date of Patent: Oct. 25, 2016

(54) THREE AND TWO HALF STROKE FREEBOOST INTERNAL COMBUSTION ENGINE

(71) Applicant: David S. Wells, Sugar Grove, IL (US)

(72) Inventor: David S. Wells, Sugar Grove, IL (US)

( * ) Notice: Subject to any disclaimer, the term of this patent is extended or adjusted under 35 U.S.C. 154(b) by 80 days.

(21) Appl. No.: 14/674,315

(22) Filed: Mar. 31, 2015

(51) Int. Cl.
*F02B 25/14* (2006.01)
*F02B 75/02* (2006.01)
*F01L 1/053* (2006.01)

(52) U.S. Cl.
CPC ..... *F02B 25/145* (2013.01); *F01L 1/053* (2013.01); *F02B 75/02* (2013.01)

(58) Field of Classification Search
CPC ..... F02B 25/14; F02B 25/145; F02B 75/02; F02B 75/021; F02B 2075/027; F02B 2075/028; F01L 1/053
USPC .... 123/45 A, 45 R, 51 A, 51 R, 90.1, 90.15, 123/90.23, 434
See application file for complete search history.

(56) References Cited

U.S. PATENT DOCUMENTS 8,412,441 B1 * 4/2013 Sturman ..... F02B 21/00 701/105
2010/0313831 A1 * 12/2010 Szybist ..... F02B 47/02 123/64
2011/0295494 A1 * 12/2011 Ma ..... F02D 13/0219 701/112
2014/0019028 A1 * 1/2014 Yacoub ..... F02D 41/0082 701/103

* cited by examiner

*Primary Examiner* — John Kwon
*Assistant Examiner* — Johnny H Hoang
(74) *Attorney, Agent, or Firm* — Wood, Phillips, Katz, Clark & Mortimer

(57) ABSTRACT

A method and apparatus is provided for operating a piston driven, internal combustion engine (10) including a the piston (40) translating in a cylinder (30). The engine (10) has an intake stroke, followed by a partial exhaust stroke, followed by a compression stroke, followed by a power stroke and then an exhaust stroke, all of which are sequentially repeated. The compression stroke has a stroke length that is less than the stroke length of the power stroke.

20 Claims, 6 Drawing Sheets

THREE AND TWO HALF STROKE FREEBOOST INTERNAL COMBUSTION ENGINE

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to piston driven, internal combustion engines, and in more particular applications, to such engines utilizing intake and exhaust valves, and in more particular applications to such engines utilizing direct fuel injection.

BACKGROUND OF THE INVENTION

Four stroke, piston driven, internal combustion engines are well known, as is the manipulation of the timing of the opening and closing of the intake and exhaust valves of such engines in relation to the position of the piston within the cylinder during each of the four strokes in conventional four stroke piston engines. In general for such engines, the intake valve is open and the exhaust valve is closed during all or most of the intake stroke, both the intake valve and the exhaust valve are closed during all or most of the compression stroke, the intake valve and the exhaust valve remain closed during all or most of the power stroke, and the intake valve is closed and the exhaust valve open during all or most of the exhaust stroke. While such engines have proven very suitable for their intended function, there is always room for improvement.

SUMMARY OF THE INVENTION

In accordance with one feature of the invention, a method is provided for operating a piston driven, internal combustion engine including a piston translating in a cylinder between a top dead center position and a bottom dead center position, an intake valve to the cylinder having an open state and a closed state, and an exhaust valve from the cylinder having an open state and a closed state. The method includes the sequential steps of:

(a) operating the intake valve to be in the open state and the exhaust valve to be in the closed state for at least a portion of an intake stroke wherein the piston moves from the top dead center position to the bottom dead center position;

(b) operating the intake valve to be in the closed state and the exhaust valve to be in the open state for at least a portion of a partial exhaust stroke wherein the piston moves from the bottom dead center position to a partial stroke position between the bottom dead center position and the top dead center;

(c) operating the intake valve to be in the closed state and the exhaust valve to be in the closed state for at least a portion of a compression stroke wherein the piston moves from the partial stroke position to the top dead center position;

(d) operating the engine to combust a fuel/air mixture in the cylinder and operating the intake valve to be in the closed state and the exhaust valve to be in the closed state for at least a portion of a power stroke wherein the piston is driven from the top dead center position to the bottom dead center position;

(e) operating the intake valve to be in the closed state and the exhaust valve to be in the open state for at least a portion of an exhaust stroke wherein the piston moves from the bottom dead center position to the top dead center position; and (f) sequentially repeating steps (a) through (e).

In one feature, step (a) includes operating the intake valve to be in the open state and the exhaust valve to be in the closed state for a majority of the intake stroke; step (b) includes operating the intake valve to be in the closed state and the exhaust valve to be in the open state for a majority of the partial exhaust stroke; step (c) includes operating the intake valve to be in the closed state and the exhaust valve to be in the closed state for at least a majority of a compression stroke; step (d) includes operating the intake valve to be in the closed state and the exhaust valve to be in the closed state for a majority of the power stroke; and step (e) includes operating the intake valve to be in the closed state and the exhaust valve to be in the open state for a majority of the exhaust stroke.

According to one feature, at least one of: step (a) includes operating the intake valve to be in the open state and the exhaust valve to be in the closed state for the entire intake stroke; step (b) includes operating the intake valve to be in the closed state and the exhaust valve to be in the open state for the entire partial exhaust stroke; step (c) includes operating the intake valve to be in the closed state and the exhaust valve to be in the closed state for the entire compression stroke; step (d) includes operating the intake valve to be in the closed state and the exhaust valve to be in the closed state for the entire power stroke; and step (e) includes operating the intake valve to be in the closed state and the exhaust valve to be in the open state for the entire exhaust stroke.

As one feature, the engine is operated with the piston connected by a crank to a crankshaft that rotates 180 degrees in response to the piston moving from the top dead center position to the bottom dead center position and that rotates another 180 degrees in response to the piston moving from the bottom dead center position to the top dead center position. Step (b) includes operating the intake valve to be in the closed state and the exhaust valve to be in the open state during less than 90 degrees of crankshaft rotation; and step (c) includes operating the intake valve to be in the closed state and the exhaust valve to be in the closed state during more than 90 degrees of crankshaft rotation.

In one feature, step (b) includes operating the intake valve to be in the closed state and the exhaust valve to be in the open state during 60 to 70 degrees of crankshaft rotation; and step (c) comprises operating the intake valve to be in the closed state and the exhaust valve to be in the closed state during 110 to 120 degrees of crankshaft rotation.

According to one feature, the method further includes the step of throttling an air flow to the intake valve during step (a) to control an operating speed of the engine, with the air flow being throttled to a greater extent at low operating speeds and to a lesser extent at high operating speeds.

In accordance with one feature of the invention, a method is provided for operating a piston driven, internal combustion engine including a piston translating in a cylinder between a top dead center position and a bottom dead center position, an intake valve to the cylinder having an open state and a closed state, and an exhaust valve from the cylinder having an open state and a closed state, the piston connected by a crank to a crankshaft that rotates 180 degrees in response to the piston moving from the top dead center position to the bottom dead center position and that rotates another 180 degrees in response to the piston moving from the bottom dead center position to the top dead center position. The method includes the sequential steps of:

(a) operating the intake valve to be in the open state and the exhaust valve to be in the closed state for at least part of the 180 degrees of crankshaft rotation as the piston move from the top dead center position to the bottom dead center position during an intake stroke of the piston;

(b) operating the intake valve to be in the closed state and the exhaust valve to be in the open state during less than 90 degrees of crankshaft rotation as the piston moves from the bottom dead center position to a partial stroke position between the bottom dead center position and the top dead center position during a partial exhaust stroke;

(c) operating the intake valve to be in the closed state and the exhaust valve to be in the closed state during more than 90 degrees of crankshaft rotation as the piston moves from the partial stroke position to the top dead center position during a compression stroke;

(d) operating the engine to combust a fuel/air mixture in the cylinder and operating the intake valve to be in the closed state and the exhaust valve to be in the closed state for at least part of the 180 degrees of crankshaft rotation as the piston is driven from the top dead center position to the bottom dead center position during a power stroke;

(e) operating the intake valve to be in the closed state and the exhaust valve to be in the open state for at least part of the 180 degrees of crankshaft rotation as the piston moves from the bottom dead center position to the top dead center position during an exhaust stroke; and (f) sequentially repeating steps (a) through (e).

In one feature, step (a) includes operating the intake valve to be in the open state and the exhaust valve to be in the closed state for a majority of the 180 degrees of crankshaft rotation as the piston move from the top dead center position to the bottom dead center position during the intake stroke of the piston. Step (b) includes operating the intake valve to be in the closed state and the exhaust valve to be in the open state during 60 to 70 degrees of crankshaft rotation as the piston moves from the bottom dead center position to a partial stroke position between the bottom dead center position and the top dead center position during the partial exhaust stroke. Step (c) includes operating the intake valve to be in the closed state and the exhaust valve to be in the closed state during 110 to 120 degrees of crankshaft rotation as the piston moves from the partial stroke position to the top dead center position during the compression stroke. Step (d) includes operating the intake valve to be in the closed state and the exhaust valve to be in the closed state for a majority of the 180 degrees of crankshaft rotation as the piston is driven from the top dead center position to the bottom dead center position during the power stroke. Step (e) includes operating the intake valve to be in the closed state and the exhaust valve to be in the open state for a majority of the 180 degrees of crankshaft rotation as the piston moves from the bottom dead center position to the top dead center position during the exhaust stroke.

In accordance with one feature of the invention, a method is provided for operating a piston driven, internal combustion engine including a piston translating in a cylinder, an intake valve to the cylinder having an open state and a closed state, and an exhaust valve from the cylinder having an open state and a closed state. The piston has an intake stroke with an intake stroke length that LI wherein air is drawn into the cylinder through the intake valve with the intake valve in the open state, a compression stroke with a compression stroke length LC wherein air within the cylinder is compressed, a power stroke with a power stroke length LP wherein the piston transfers power generated by a combustion of the compressed air with a fuel in the cylinder, and an exhaust stroke with an exhaust stroke length LE wherein products of the combustion are forced from the cylinder through the exhaust valve with the exhaust valve in the open state. The method includes the step of operating the inlet and outlet valves of the engine so that the piston has a partial exhaust stroke between the intake stroke and the compression stroke, with a partial exhaust stroke length LPE, wherein the intake valve is in the closed state and the exhaust valve is in the open state so that initially during the partial exhaust stroke, exhaust and pressure from the exhaust manifold will enter the cylinder. During the remainder of the partial exhaust stroke, some or all of the exhaust that had entered the cylinder will be expelled, but the increased pressure will remain.

As one feature, the engine is operated so that the power stroke length LP is 20 to 30 percent longer than the compression stroke length LC.

In one feature, the intake valve and the exhaust valve are operated to the closed states while the piston translates over the compression stroke length LC.

According to one feature, the intake valve and exhaust valve are operated so that both the exhaust stroke length LE and the intake stroke length LI are approximately the same length as the power stroke length LP, with the intake valve being in the closed state and the exhaust valve being in the open state while the piston translates over the exhaust stroke length LE, and the intake valve being in the open state and the exhaust valve being in the closed state while the piston translates over the intake stroke length LI.

As one feature, the intake and exhaust valves are operated so that the partial exhaust stroke length LPE is less than the compression stroke length LC.

In accordance with one feature of the invention, an internal combustion engine includes:

a piston mounted for translation in a cylinder between a top dead center position and a bottom dead center position;

an intake valve to the cylinder, the intake valve having an open state and a closed state; and an exhaust valve from cylinder, the exhaust valve having an open state and a closed state. The engine is configured to automatically operate the intake and the exhaust valves to sequentially achieve:

(a) an intake stroke wherein the piston moves from the top dead center position to the bottom dead center position with the intake valve in the open state and the exhaust valve in the closed state for at least a portion of the intake stroke;

(b) a partial exhaust stroke wherein the piston moves from the bottom dead center position to a partial stroke position between the bottom dead center position and the top dead center position with the intake valve in the closed state and the exhaust valve in the open state for at least a portion of the partial exhaust stroke;

(c) a compression stroke wherein the piston moves from the partial stroke position to the top dead center position with the intake valve in the closed state and the exhaust valve in the closed state for at least a portion of the compression stroke;

(d) a power stroke wherein the piston is driven from the top dead center position to the bottom dead center position following a combustion of a fuel/air mixture in the cylinder, with the intake valve in the closed state and the exhaust valve in the closed state for at least a portion of the power stroke; and (e) an exhaust stroke wherein the piston moves from the bottom dead center position to the top dead center position with the intake valve in the closed state and the exhaust valve in the open state for at least a portion of the exhaust stroke.

In one feature, the internal combustion engine further includes first and second exhaust valve cam shafts. The first exhaust valve cam shaft is configured to operate the exhaust valve to the open state during the exhaust stroke and the second exhaust valve cam shaft is configured to operate the exhaust valve to the open state during the partial exhaust stroke.

As one feature, the internal combustion engine further includes a rocker arm having a first surface in operable engagement with a first cam on the first exhaust valve cam shaft, a second surface in operable engagement with a second cam on the second exhaust cam shaft, and a third surface that transfers opening forces to the exhaust valve.

According to one feature, the internal combustion engine further includes an exhaust valve cam shaft carrying an exhaust valve cam having a surface configured to transfer opening forces to the exhaust valve during the exhaust stroke and the partial exhaust stroke.

As one feature, the internal combustion engine further includes an exhaust valve solenoid configured to operate the exhaust valve to the open and closed states as required for each of the strokes in response to an electrical signal.

In one feature, the engine is configured to automatically operate the intake and the exhaust valves to actuate:

(a) the intake valve in the open state and the exhaust valve in the closed state for a majority of the intake stroke;

(b) the intake valve in the closed state and the exhaust valve in the open state for a majority of the partial exhaust stroke;

(c) the intake valve in the closed state and the exhaust valve in the closed state for a majority of the compression stroke;

(d) the intake valve in the closed state and the exhaust valve in the closed state for a majority of the power stroke; and (e) the intake valve in the closed state and the exhaust valve in the open state for a majority of the exhaust stroke.

According to one feature, the engine is configured to automatically operate the intake and the exhaust valves to actuate:

(a) the intake valve in the open state and the exhaust valve in the closed state for the entire intake stroke;

(b) the intake valve in the closed state and the exhaust valve in the open state for the entire partial exhaust stroke;

(c) the intake valve in the closed state and the exhaust valve in the closed state for the entire compression stroke;

(d) the intake valve in the closed state and the exhaust valve in the closed state for the entire power stroke; and (e) the intake valve in the closed state and the exhaust valve in the open state for the entire exhaust stroke.

Other objects, features, and advantages of the invention will become apparent from a review of the entire specification, including the appended claims and drawings.

DETAILED DESCRIPTION OF THE PREFERRED EMBODIMENT

A piston driven, internal combustion engine and operating cycle are disclosed herein. The operating cycle includes an intake stroke wherein air or other suitable gases for oxidizing combustion are drawn into the cylinder, a partial exhaust stroke wherein the intake to the cylinder is closed and the exhaust from the cylinder is open while the volume within the cylinder is decreased, a compression stroke wherein both the intake to the cylinder and the exhaust from the cylinder are blocked while the volume within the cylinder is further reduced thereby compressing the gases within the cylinder, a combustion of the compressed gases within the cylinder (which in the preferred embodiments include fuel that been directly injected into the cylinder at some point after the partial exhaust stroke has been completed), a power stroke wherein the energy from the combustion is transferred to the piston as the products of combustion expand within the cylinder, and an exhaust stroke wherein the cylinder is open to the exhaust while the piston reduces the volume within the cylinder to drive the products of combustion from the cylinder. For convenience, the operating cycle as disclosed herein will be referred to as 3-2/2 stroke operating cycle and the engine 10 as disclosed herein as a 3-2/2 stroke engine to distinguish from conventional four stroke operating cycles and four stroke internal combustion engines. The engine 10 as disclosed herein is configured to provide the partial exhaust stroke between the intake stroke of the cycle and the compression stroke of the cycle, with the intake, exhaust and power strokes of the cycle being essentially full strokes as is conventional for 4-stroke, piston driven internal combustion engine, the compression stroke being a partial stroke, and the partial exhaust stroke being a partial stroke.

Figure 7:
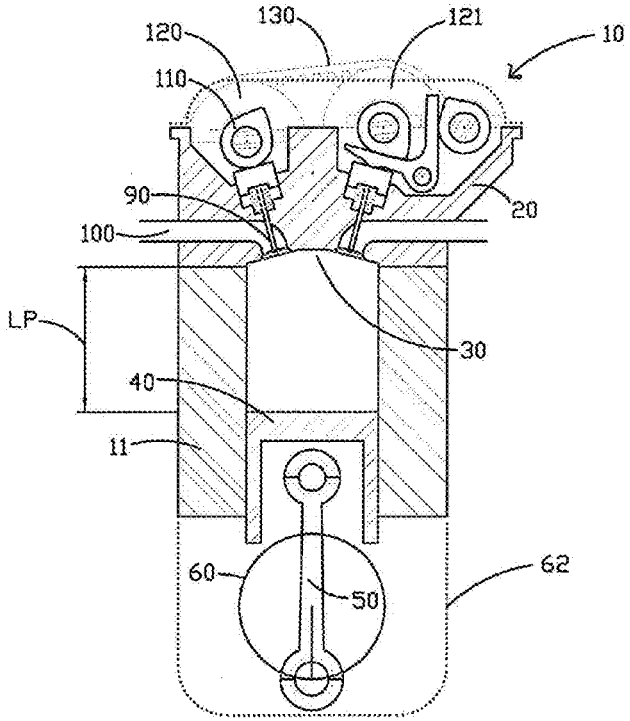
FIG. 7 is a sectional view of a 3-2/2 stroke engine with the crankshaft having rotated 540 degrees at the end of the power stroke and the beginning of the exhaust full stroke.
Figure 8:
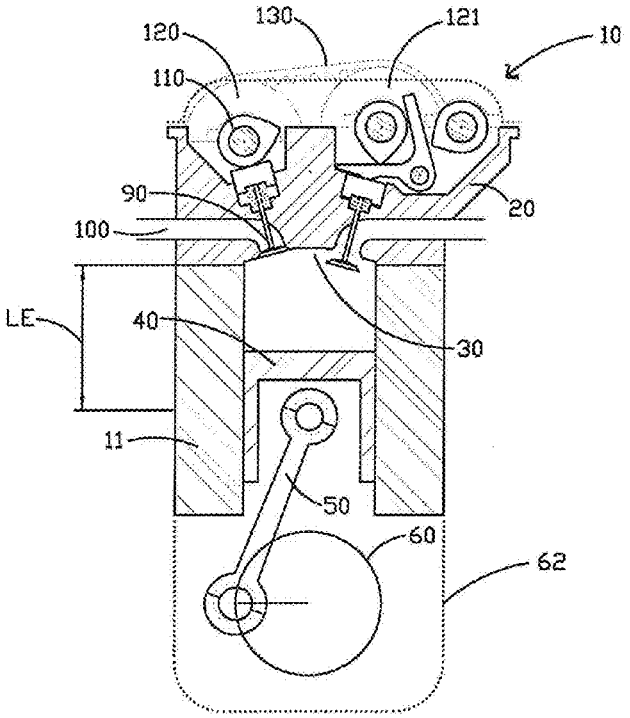
FIG. 8 is a sectional view of a 3-2/2 stroke engine with the crankshaft having rotated 630 degrees midway through the exhaust full stroke.
Figure 8A:
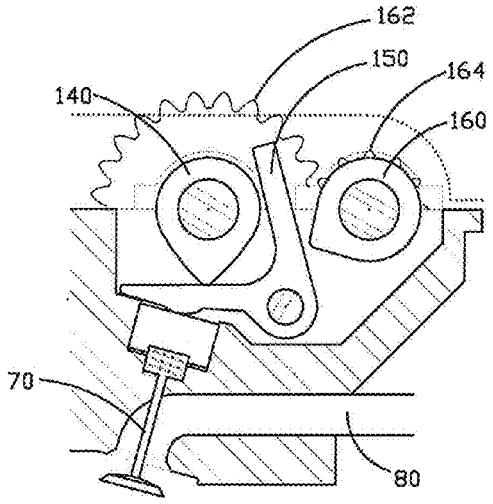
FIG. 8*a* is an enlarged sectional view of the exhaust mechanisms of the engine in FIG. 8 showing the position of the exhaust full stroke camshaft, the rocker arm and the partial exhaust stroke camshaft.
Figure 9:
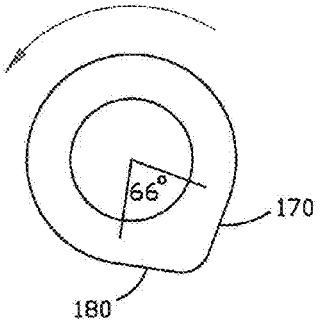
FIG. 9 is an enlarged view of the partial exhaust stroke camshaft.
Figure 10:
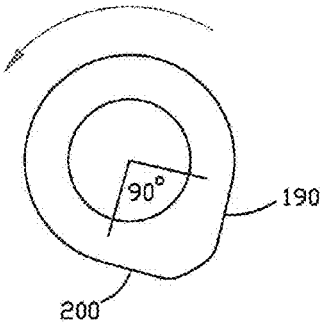
FIG. 10 shows an enlarged view of an alternate partial exhaust stroke camshaft.

One embodiment of a 3-2/2 stroke internal combustion, direct fuel injected, piston engine 10 is shown somewhat diagrammatically in FIGS. 1-8*a*, with FIGS. 9 and 10 illustrating a cam for driving an exhaust valve of the engine 10 during the partial exhaust stroke and FIGS. 11-14*a* showing various alternate embodiments for the structures that provide the full exhaust stroke and the partial exhaust stroke of the 3-2/2 operating cycle for the 3-2/2 engine 10.

The 3-2/2 stroke, direct fuel injected, spark ignition, piston, internal combustion engine has been analyzed based on an assumption that, of the residual products of combustion left in the cylinder following the exhaust stroke, half will be drawn down into the cylinder and mixed with the incoming air and the other half will remain concentrated at the top of the cylinder near the exhaust valve and in the lee of the intake valve.

The partial exhaust stroke in the 3-2/2 stroke engine is accomplished by opening the exhaust valve for 20% or approximately the first 20% (20 to 30 percent) of what in a 4 stroke engine is termed the compression stroke. In the 3-2/2 stroke engine, this portion of the upward stroke is termed the "partial exhaust stroke" and its duration will be 66 degrees or approximately 66 degrees (60 to 70 percent) of crankshaft rotation. Compression takes place during the remaining 80% or approximately 80% (70 to 80 percent) of the upward stroke with a duration of 114 degrees or approximately 114 degrees (110 to 120 degrees) of crankshaft rotation. This portion of the upward stroke is termed the "compression stroke". Thus, as previously discussed, the engine will have three full strokes: the intake stroke, the power or expansion stroke and the exhaust full stroke; and two partial strokes: the partial exhaust stroke and the compression stroke.

While the above ranges for degrees of rotation and/or percent of stroke will be desired in many applications, it should be understood that the invention contemplates that in some applications it may be desirable for the exhaust valve 70 to be open for 90° of crankshaft rotation or for crankshaft rotations that are less than 90° of crankshaft rotation during the partial exhaust stroke and for the intake valve 90 and the exhaust valve 70 to be in the closed state during 90° of crankshaft rotation or more than 90° of crankshaft rotation during the compression stroke.

Figure 5:
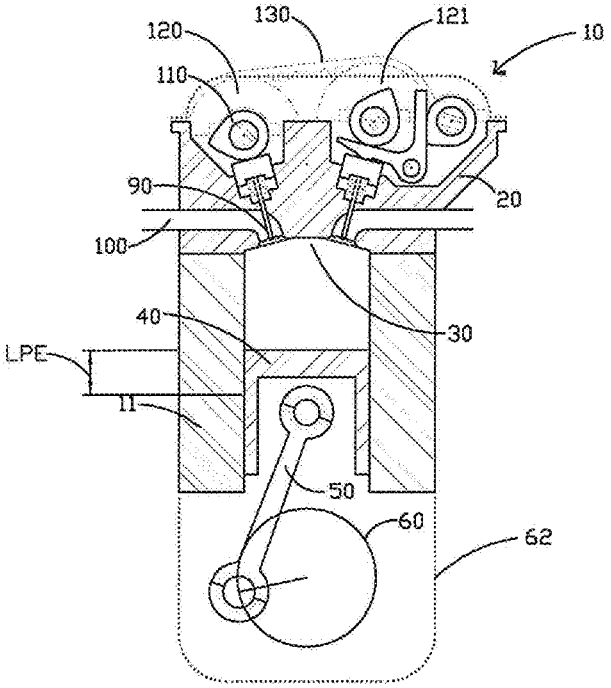
FIG. 5 is a sectional view of a 3-2/2 stroke engine with the crankshaft having rotated 246 degrees at the end of the partial exhaust stroke and the beginning of the compression stroke.

For the disclosed 3-2/2 operating cycle and 3-2/2 engine 10, the intake stroke will have an intake stroke length LI (FIG. 3) wherein air is drawn into the cylinder, a compression stroke with a compression stroke length LC (FIG. 6) wherein air within the cylinder is compressed, a power stroke with a power stroke length LP (FIG. 7) wherein the piston transfers power generated by combustion of the compressed air with a fuel, an exhaust stroke with an exhaust stroke length LE (FIG. 8) wherein products of the combustion are exhausted, and a partial exhaust stroke between the intake stroke and the compression stroke, the partial exhaust stroke having a partial exhaust stroke length LPE (FIG. 5). In some embodiments, the partial stroke length LPE is less than the compression stroke length LC. In the preferred embodiments of the 3-2/2 operating cycle and 3-2/2 engine 10, the power stroke length LP is 20 to 30 percent longer than the compression stroke length LC, with the exact percentage difference being dependent upon the desired operating parameters of the engine 10 by this point in the cycle. Further, in the preferred embodiments, the exhaust stroke length LE and the intake stroke length LI are approximately the same length as the power stroke length LP.

At the end of the intake stroke and just prior to the partial exhaust stroke at high rpm with the air throttle near fully open, the pressure in the cylinder can be as high as 13 or 14 psi and the pressure in the exhaust manifold will be around 15 or 16 psi in the disclosed 3-2/2 engine 10. When the exhaust valve opens at the beginning of the partial exhaust stroke, exhaust and pressure from the exhaust manifold will enter the cylinder. During the remainder of the partial exhaust stroke, some of the exhaust and a small amount of air will be expelled from the cylinder, but the added pressure will remain. Calculations taking into consideration the temperature and density of the gasses in the cylinder indicate that, at the end of the partial exhaust stroke and the beginning of the compression stroke, the charge in the cylinder will be cleaner, cooler and denser than in a comparably sized four stroke engine of the same compression ratio. That coupled with the small boost in pressure during the partial exhaust stroke and the fact that the power stroke is 58% longer than the compression stroke in terms of degrees of crankshaft rotation will make the 3-2/2 stroke engine both more powerful and up to 20% more efficient at high rpm.

At the end of the intake stroke and just prior to the partial exhaust stroke at low rpm with the air throttle near fully closed, the pressure in the cylinder can be as low as 5 or 6 psi and the pressure in the exhaust manifold will be around 15 or 16 psi in the disclosed 3-2/2 engine 10. When the exhaust valve opens at the beginning of the partial exhaust stroke, exhaust and pressure from the exhaust manifold will enter the cylinder. During the remainder of the partial exhaust stroke, some of that exhaust will be expelled from the cylinder, but the added pressure will remain. Calculations taking into consideration the temperature and density of the gasses in the cylinder indicate that at the end of the partial exhaust stroke and the beginning of the compression stroke the charge in the cylinder will be 84% air and the charge in a four stroke engine of the same compression ratio just prior to the compression stroke will be 94%. This is not as big a difference as it seems. Since pure air already contains 80% impurities in the form of nitrogen it works out that the charge in the 3-2/2 stroke engine has 83% impurities and that in the four stroke engine 81% impurities which is insignificant considering the pressure has been boosted by a factor of 3. That coupled with the fact that the power stroke is 58% longer than the compression stroke in terms of degrees of crankshaft rotation will make the 3-2/2 stroke engine both more powerful and up to 50% more efficient at low rpm.

In the 3-2/2 stroke engine since the exhaust valve opens during the partial exhaust stroke fuel may not be injected until the compression stroke, and since at low rpm hot exhaust gasses enter the cylinder from the exhaust manifold, the fuel should be injected late in the compression stroke at a time when it is desirable for combustion to occur in order to prevent auto-ignition of the fuel air charge.

Additional means of achieving a 3-2/2 stroke engine are also shown herein.

Figure 1:
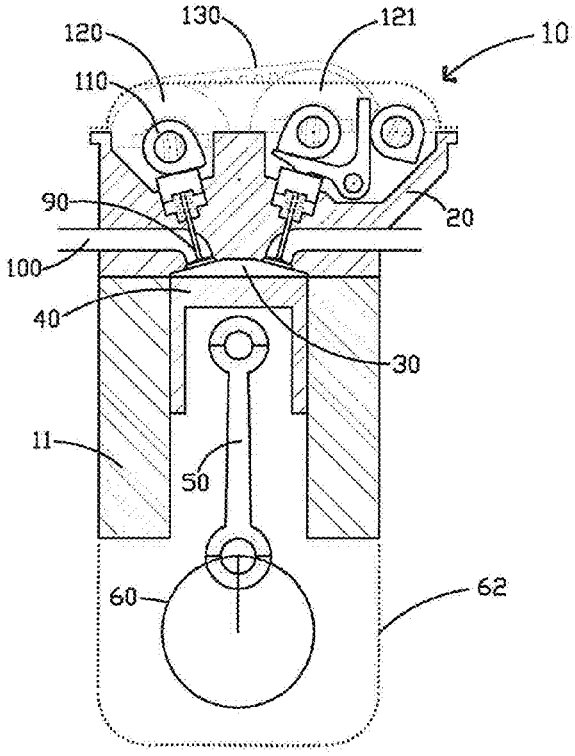
FIG. 1 is a sectional view of a 3-2/2 stroke engine with the crankshaft at 0 degrees, Top Dead Center (TDC), just after the exhaust full stroke and prior to the intake stroke.
Figure 1A:
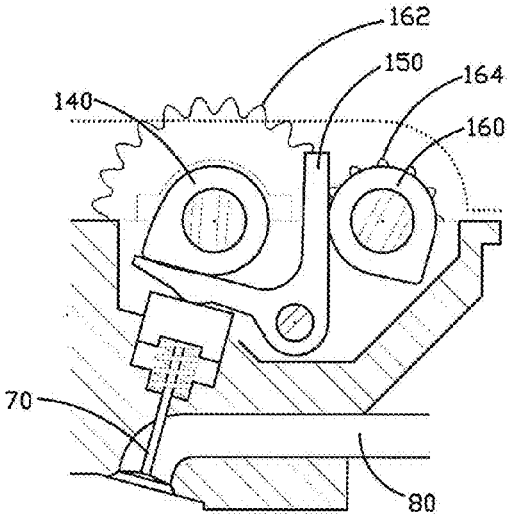
FIG. 1*a* is an enlarged sectional view of the exhaust mechanisms of the engine in FIG. 1 showing the position of the exhaust full stroke camshaft, the rocker arm and the partial exhaust stroke camshaft when the crankshaft is at 0 degrees TDC.

As best seen in FIGS. 1 and 1*a*, the engine 10 includes a block 11, a head 20, a cylinder 30, a piston 40, a connecting rod 50, a crankshaft 60, a crankcase 62, an exhaust valve 70, an exhaust port 80, an intake valve 90, an intake port 100, an intake valve camshaft 110, timing belt sprockets 120 and 121, a timing belt 130, an exhaust full stroke camshaft 140, a rocker arm 150, and an exhaust partial stroke camshaft 160. As best seen in FIG. 1*a*, mating spur gears 162 and 164 having a 2/1 gear ratio are fixed for rotation with their respective cam shafts 140 and 160 and are positioned axially adjacent the timing belt sprockets 120 and 121. The engine 10 is shown in FIGS. 1 and 1*a* immediately after the exhaust stroke and immediately prior to the intake stroke, with the crankshaft 60 at 0 degrees top dead center (TDC), the piston 40 at the top of its stroke.

Figure 2:
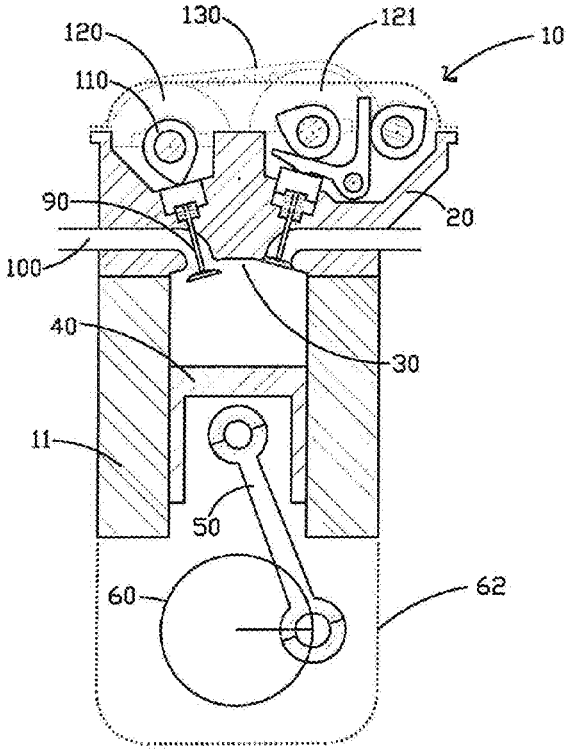
FIG. 2 is a sectional view of a 3-2/2 stroke engine with the crankshaft having rotated 90 degrees midway through the intake stroke.
Figure 2A:
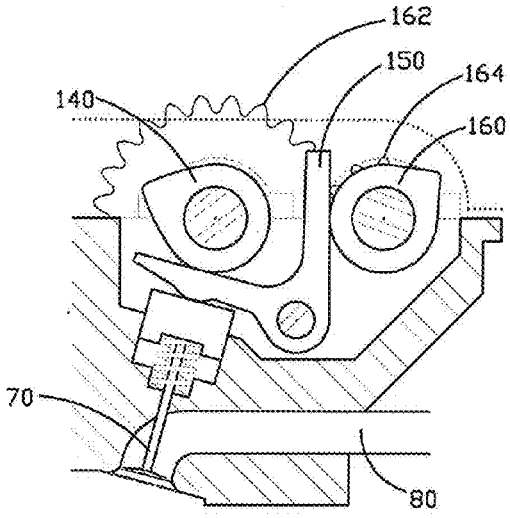
FIG. 2*a* is an enlarged sectional view of the exhaust mechanisms of the engine in FIG. 2 showing the position of the exhaust full stroke camshaft, the rocker arm and the partial exhaust stroke camshaft.

FIG. 2 shows the engine 10 midway through the intake stroke. The crankshaft 60 has rotated 90 degrees clockwise, the intake camshaft 110 has rotated 45 degrees clockwise and the intake valve 90 is now open. FIG. 2*a* shows the position of the exhaust valve 70, the exhaust full stroke camshaft 140, the rocker arm 150 and the partial exhaust stroke camshaft 160 with the crankshaft having rotated 90 degrees. The exhaust valve 70 remains closed. The exhaust full stroke camshaft 140 has rotated 45 degrees clockwise. The partial exhaust stroke camshaft 160 has rotated 90 degrees counter-clockwise. The rocker arm 150 has not moved.

Figure 3:
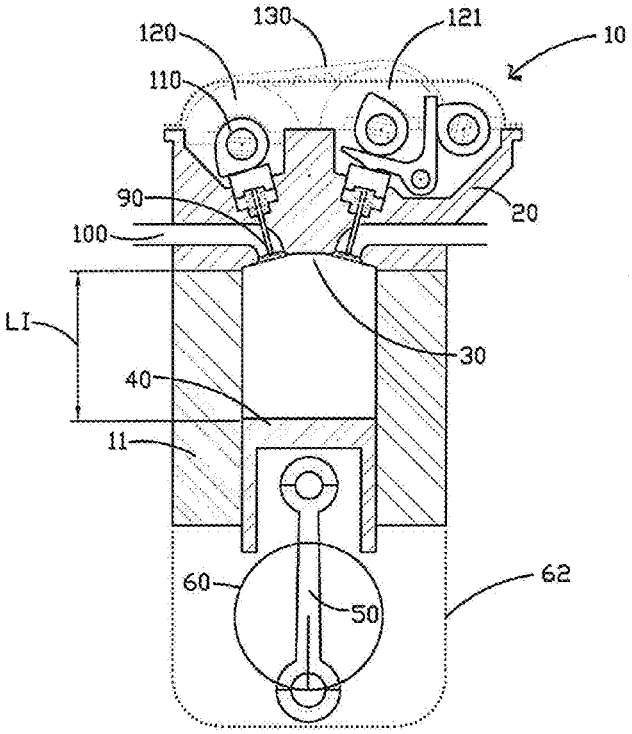
FIG. 3 is a sectional view of a 3-2/2 stroke engine with the crankshaft having rotated 180 degrees at the end of the intake stroke and the beginning of the partial exhaust stroke.
Figure 3A:
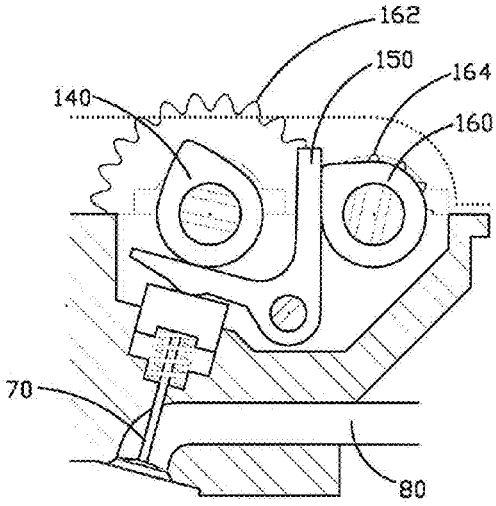
FIG. 3*a* is an enlarged sectional view of the exhaust mechanisms of the engine in FIG. 3 showing the position of the exhaust full stroke camshaft, the rocker arm and the partial exhaust stroke camshaft.

FIG. 3 shows the engine 10 at the end of the intake stroke and just prior to the partial exhaust stroke. The crankshaft 60 has rotated 180 degrees clockwise to the bottom dead center (BDC) position, the intake camshaft 110 has rotated 90 degrees clockwise and the intake valve 90 is now closed. FIG. 3*a* shows the position of the exhaust valve 70, the exhaust full stroke camshaft 140, the rocker arm 150 and the partial exhaust stroke camshaft 160 with the crankshaft having rotated 180 degrees. The exhaust valve 70 remains closed. The exhaust full stroke camshaft 140 has rotated 90 degrees clockwise. The partial exhaust stroke camshaft 160 has rotated 180 degrees counter-clockwise. The rocker arm 150 has not moved.

Figure 4:
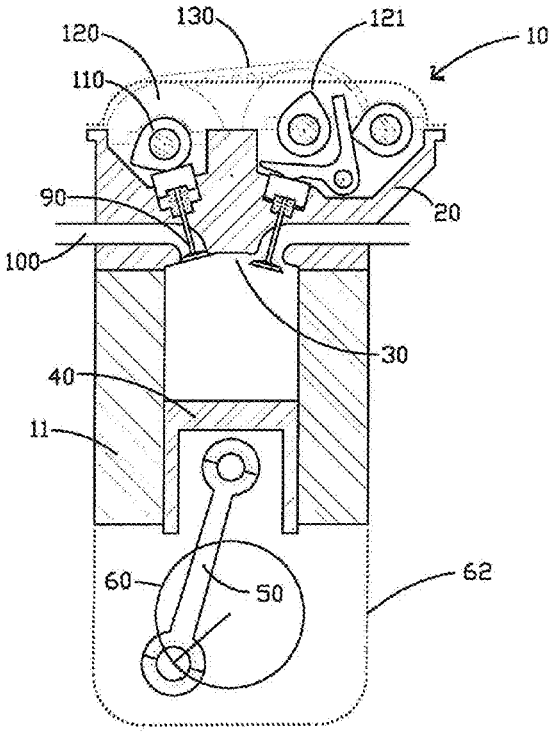
FIG. 4 is a sectional view of a 3-2/2 stroke engine with the crankshaft having rotated 213 degrees midway through the partial exhaust stroke.
Figure 4A:
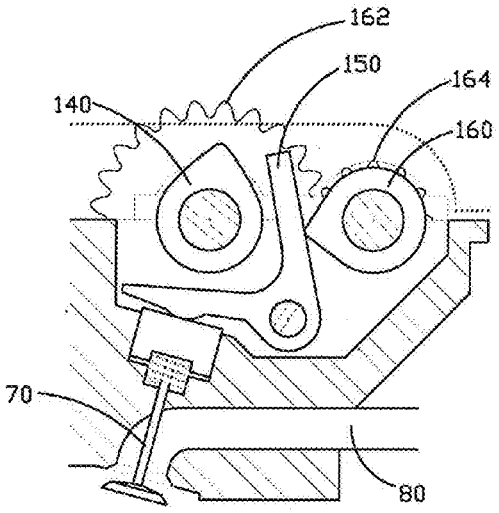
FIG. 4*a* is an enlarged sectional view of the exhaust mechanisms of the engine in FIG. 4 showing the position of the exhaust full stroke camshaft, the rocker arm and the partial exhaust stroke camshaft.

FIG. 4 shows the 3-2/2 engine 10 midway through the partial exhaust stroke. The crankshaft 60 has rotated 213 degrees clockwise, the intake camshaft 110 has rotated 106.5 degrees clockwise and the intake valve 90 is closed. FIG. 4*a* shows the position of the exhaust valve 70, the exhaust full stroke camshaft 140, the rocker arm 150, and the partial exhaust stroke camshaft 160 with the crankshaft 60 having rotated 213 degrees. The exhaust full stroke camshaft 140 has rotated 106.5 degrees clockwise. The partial exhaust stroke camshaft 160 has rotated 213 degrees counter-clockwise and is engaging the rocker arm 150 which has pushed the exhaust valve 70 to a fully open position.

Figure 5A:
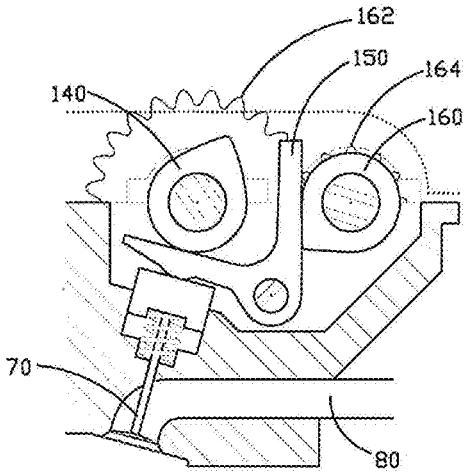
FIG. 5*a* is an enlarged sectional view of the exhaust mechanisms of the engine in FIG. 5 showing the position of the exhaust full stroke camshaft, the rocker arm and the partial exhaust stroke camshaft.

FIG. 5 shows the 3-2/2 engine 10 at the end of the partial exhaust stroke and the beginning of the compression half stroke. The crankshaft 60 has rotated 246 degrees clockwise, the intake camshaft 110 has rotated 123 degrees clockwise and the intake valve 90 is closed. FIG. 5*a* shows the position of the exhaust valve 70, the exhaust full stroke camshaft 140, the rocker arm 150 and partial exhaust stroke camshaft 160 with the crankshaft 60 having rotated 246 degrees. The exhaust valve 70 is closed. The exhaust full stroke camshaft 140 has rotated 123 degrees clockwise. The partial exhaust stroke camshaft 160 has rotated 246 degrees counter-clockwise.

Figure 6:
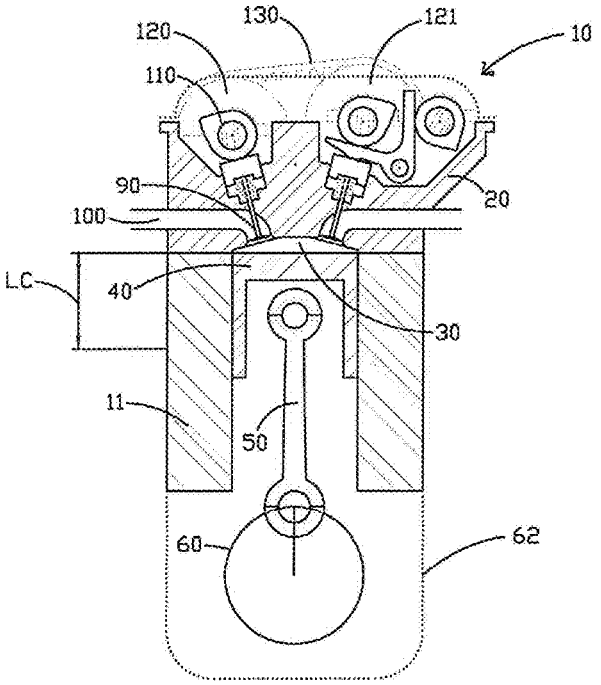
FIG. 6 is a sectional view of a 3-2/2 stroke engine with the crankshaft having rotated 360 degrees at the end of the compression stroke and the beginning of the power stroke.
Figure 6A:
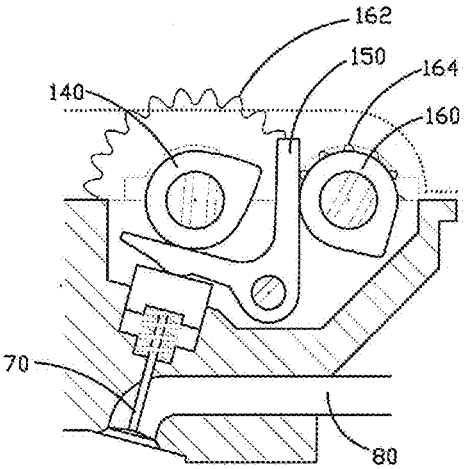
FIG. 6*a* is an enlarged sectional view of the exhaust mechanisms of the engine in FIG. 6 showing the position of the exhaust full stroke camshaft, the rocker arm and the partial exhaust stroke camshaft.

FIG. 6 shows the 3-2/2 engine 10 at the end of the compression stroke and the beginning of the power stroke. The crankshaft 60 has rotated 360 degrees clockwise, the intake camshaft 110 has rotated 180 degrees clockwise and the intake valve 90 is closed. FIG. 6*a* shows the position of the exhaust valve 70, the exhaust full stroke camshaft 140, the rocker arm 150 and partial exhaust stroke camshaft 160 with the crankshaft 60 having rotated 360 degrees. The exhaust valve 70 is closed. The exhaust full stroke camshaft 140 has rotated 180 degrees clockwise. The partial exhaust stroke camshaft 160 has rotated 360 degrees counter-clockwise.

It should be understood that the illustrated embodiment of the 3-2/2 engine 10 is a direct fuel injection engine wherein fuel is directly injected into the cylinder 30 at some point after the partial exhaust stroke and before combustion. In this regard, the fuel will typically be injected at some point at or near the end of the compression stroke and at or near the beginning of the power stroke. It should also be understood that while in many applications it will be desirable for the 3-2/2 engine 10 to be a direct fuel injection engine, in some applications it may be desirable for the engine 10 to utilize other types of fuel injection or other suitable ways for introducing fuel into the cylinder 30 for combustion. It should further be understood that the speed of the disclosed 3-2/2 engine can be controlled with the use of an air throttle upstream of the intake manifold 100. However, in some embodiments, it may be desirable to control the amount of air flow into the cylinder using variable intake valves, in which case the use of an air throttle would not be required. Alternatively, in some embodiments it may be desirable to utilize so-called "Stratified Charge Ultra Lean Burn" technology in which there is no air throttle and no restriction of air flow at the intake valve 9, and wherein air is allowed to enter the cylinder 30 at just under atmospheric pressure at any rpm, with the engine speed being controlled entirely by the amount of fuel added in a stratified charge.

Figure 7A:
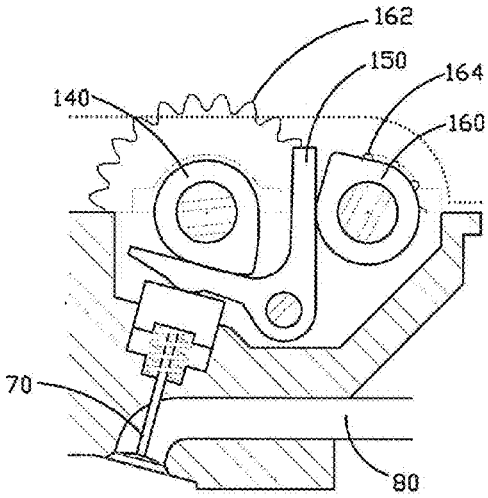
FIG. 7*a* is an enlarged sectional view of the exhaust mechanisms of the engine in FIG. 7 showing the position of the exhaust full stroke camshaft, the rocker arm and the partial exhaust stroke camshaft.

FIG. 7 shows the 3-2/2 engine 10 at the end of the power stroke and the beginning of the exhaust full stroke. The crankshaft 6 has rotated 540 degrees clockwise, the intake camshaft 110 has rotated 270 degrees clockwise and the intake valve 90 is closed. FIG. 7*a* shows the position of the exhaust valve 70, the exhaust full stroke camshaft 140, the rocker arm 150 and partial exhaust stroke camshaft 160 with the crankshaft 60 having rotated 540 degrees. The exhaust valve 70 is closed. The exhaust full stroke camshaft 140 has rotated 270 degrees clockwise. The partial exhaust stroke camshaft 160 has rotated 540 degrees counter-clockwise.

FIG. 8 shows the 3-2/2 engine 10 midway through the exhaust full stroke. The crankshaft 60 has rotated 630 degrees clockwise, the intake camshaft 110 has rotated 315 degrees clockwise and the intake valve 90 is closed. FIG. 8*a* shows the position of the exhaust valve 70, the exhaust full stroke camshaft 140, the rocker arm 150 and partial exhaust stroke camshaft 160 with the crankshaft 60 having rotated 630 degrees. The exhaust full stroke camshaft 140 has rotated 315 degrees clockwise and is engaging the rocker arm 150 which is in turn pushing the exhaust valve 70 to a fully open position. The partial exhaust stroke camshaft 160 has rotated 630 degrees counter-clockwise and is no longer touching the rocker arm 150.

FIG. 9 is an enlarged view of the partial exhaust half stroke camshaft 160. There is 66 degrees between the beginning of the valve opening lobe ramp 170 and the end of the valve closing lobe ramp 180. Since the partial exhaust stroke camshaft 160 rotates counter-clockwise at the same rpm as the clockwise rotating crankshaft 60, the exhaust valve 70 will be open for 66 degrees of crankshaft rotation.

FIG. 10 is an enlarged view of an alternate partial exhaust stroke camshaft 160 with 90 degrees between the beginning of the valve opening lobe ramp 190 and the end of the valve closing lobe ramp 200. Since the partial exhaust stroke camshaft 160 rotates counter-clockwise at the same rpm as the crankshaft 60, the exhaust valve 70 will be open for 90 degrees of crankshaft rotation.

Figure 11:
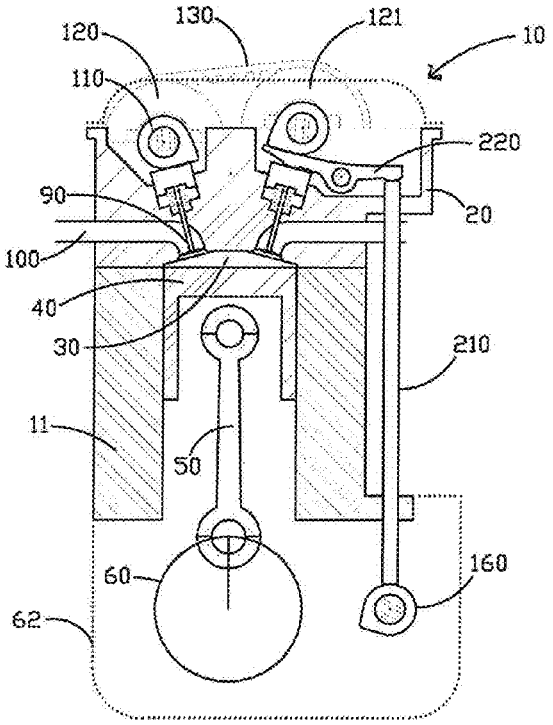
FIG. 11 is a sectional view of a 3-2/2 stroke engine equipped with a partial exhaust stroke camshaft located in the crankcase.

FIG. 11 shows an alternate structure for a 3-2/2 stroke internal combustion, fuel injected, piston engine 10. The FIG. 11 engine 10 is the same as shown in FIG. 1, but with the partial exhaust stroke camshaft 160 relocated to the crankcase 62 of the engine 10. From that position the camshaft 160 operates the exhaust valve 70 via a lifter rod 210 and a rocker arm 220.

Figure 12:
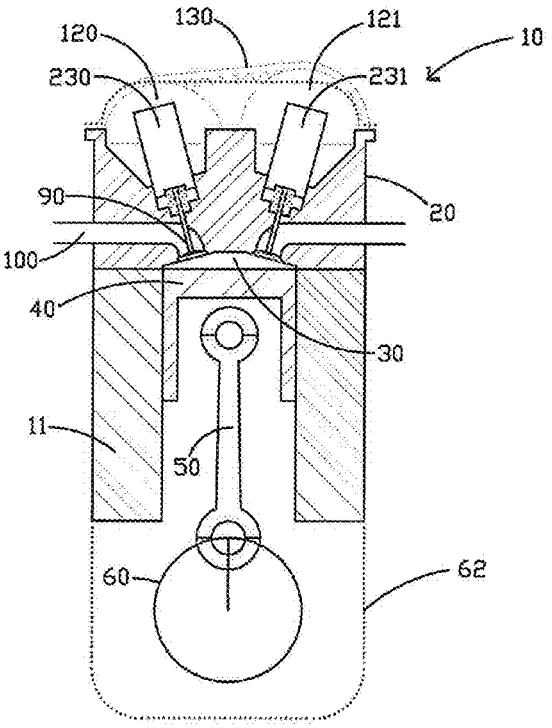
FIG. 12 is a sectional view of a 3-2/2 stroke engine equipped with computer controlled electronic valve operators.

FIG. 12 shows an alternate structure for a 3-2/2 stroke internal combustion, fuel injected, piston engine 10. The FIG. 12 engine 10 is the same basic engine as previously shown, but instead of camshafts operating the intake valve 90 and the exhaust valve 70, computer controlled electronic valve operators 230, such as valve solenoids 230, control the exhaust valve 70 and the intake valve 90 to their open and closed states in response to electrical signals from a controller.

Figure 13:
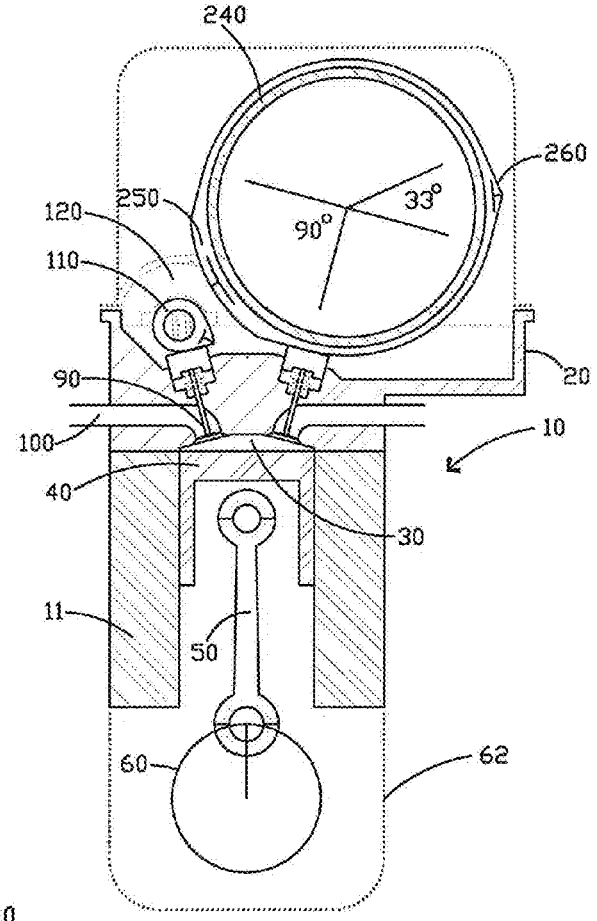
FIG. 13 is a sectional view of a 3-2/2 stroke engine equipped with an oversized, double lobed, tubular exhaust camshaft with lobes for both the exhaust full stroke and the partial exhaust stroke.

FIG. 13 shows an alternate structure for a 3-2/2 stroke internal combustion, fuel injected, piston engine 10. It is the same basic engine 10 as shown in FIG. 1, but instead of having the two exhaust camshafts 140 and 160, the FIG. 13 engine 10 includes a single oversized, double lobed, tubular camshaft 240 with one lobe 250 for the exhaust full stroke and one lobe 260 for the partial exhaust stroke. Because the camshaft 240 rotates clockwise at one half the rpm of the crankshaft 60, the 90° arc of the lobe 250 will open the exhaust valve 70 for 180° of crankshaft rotation, and the 33° arc of the lobe 260 will open the exhaust valve 70 for 66° of crankshaft rotation.

Figure 14:
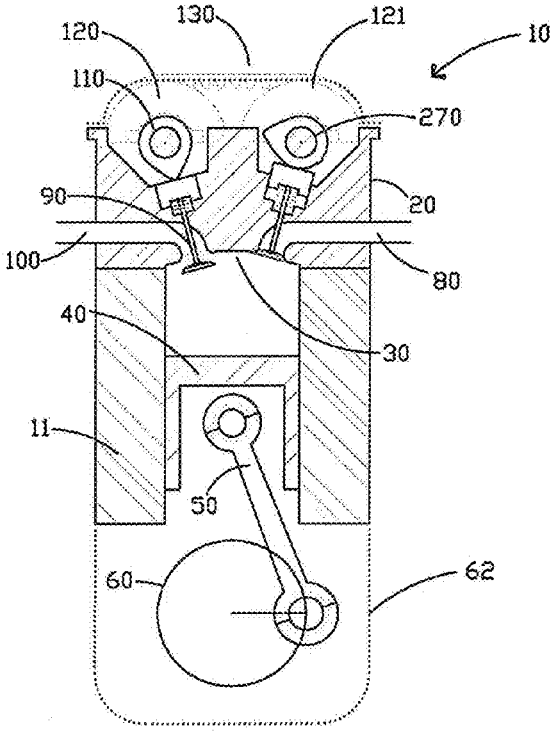
FIG. 14 is a sectional view of a 3-2/2 stroke engine equipped with a "normal" sized, double lobed, exhaust camshaft with lobes for both the exhaust full stroke and the partial exhaust stroke.

FIG. 14 shows an alternate structure for a 3-2/2 stroke internal combustion, fuel injected, piston engine 10. It is the same basic engine 10 as shown in FIG. 1, but instead of having two exhaust camshafts 140 and 160, the FIG. 14 engine includes a single "normal" sized, double lobed, camshaft 270, with one lobe 280 for the exhaust full stroke and one lobe 290 for the partial exhaust stroke.

Figure 14A:
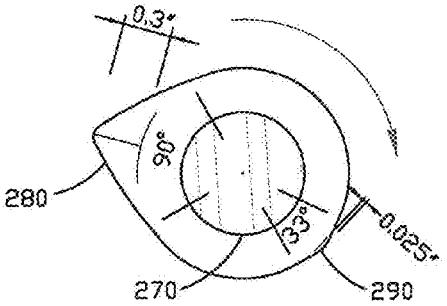
FIG. 14*a* is an enlarged view of the double lobed exhaust camshaft of FIG. 14.

FIG. 14*a* is an enlarged view of the double lobed exhaust camshaft 270. In the illustrated embodiment, and for a specific sizing of the illustrated embodiment, the lobe 280 for the full exhaust stroke will open the exhaust valve 70 by 0.3 inches at the midpoint of the exhaust stroke, and the lobe 290 for the partial exhaust stroke will open the exhaust valve 70 by 0.025 inches at the midpoint of the partial exhaust stroke. Even though 0.025" is a relatively small opening, some exhaust gases and pressure from the exhaust manifold 80 will enter the cylinder 30 during the partial exhaust stroke. Because the camshaft 270 rotates at half the rpms as the crankshaft 60, the 90° arc of the lobe 280 will open the valve 70 for 180° of crankshaft rotation, and the 33° arc of the lobe 290 will open the exhaust valve 70 for 66° of crankshaft rotation.

Analysis has shown that the 3-2/2 stroke engine disclosed herein can improve fuel efficiency at low rpm with the air throttle nearly fully closed by 40-50% in comparison to conventional four stroke engines. This is important because it has been estimated that approximately 90% of automobile driving takes place while cruising in the lower rpm ranges (1,000 rpm to 2,000 rpm in many conventional engines), with higher engine rpms only being experienced during situations of extreme acceleration or load, such as towing a trailer up a hill.

At low rpms, the intake air can be as low as 5 or 6 psi into the cylinder. When the exhaust valve 70 opens during the partial exhaust stroke, the pressure in the cylinder 30 is boosted to around 15 or 16 psi while exhaust gas enters from the exhaust manifold 80 via the exhaust valve 70. During the rest of the partial exhaust stroke, most of the exhaust gas that entered via the valve 70 is expelled, but the gases in the cylinder 30 remain at the higher pressure. This results in a pressure boost wherein the pressure in the cylinder 30 at the beginning of the compression stroke is around 15 to 16 psi, whereas in a conventional four stroke engine the pressure in the cylinder would be 5 or 6 psi.

At high rpms, the intake air in the cylinder 30 can be as high as 13 psi. When the exhaust valve 70 opens during the partial exhaust stroke, the pressure in the cylinder 30 is slightly boosted to around 15 or 16 psi via the exhaust gas entering through the exhaust valve 70. Again, during the rest of the partial exhaust stroke, the exhaust gas that entered during the initial opening of the exhaust valve 70 is expelled, along with a small amount of air, but the gases in the cylinder 30 remain at the higher pressure. The result is that the 3-2/2 stroke engine 10, the charge at the beginning of the compression stroke is around 15 to 16 psi. The pressure boost experienced at the low rpms in the disclosed engine 10 is similar to that experienced in a turbo charged or super charged engine which can boost the pressure in the cylinder by 6 to 8 psi and any rpm. However, the increase in pressure in a turbo charged or super charged conventional four stroke engine is the result of adding a greater mass of air which in turn requires more fuel in order to remain stoichiometrically balanced, i.e., one part fuel to 15 parts air by weight for proper combustion. The 3-2/2 stroke engine obtains the boost without the added cost of a turbo charger or super charger or the work required to operate one.

While specific embodiments of the 3-2/2 operating cycle and 3-2/2 engine have been described herein in detail, it should be understood that this disclosure encompasses and contemplates modifications to the detailed descriptions shown herein. In this regard, consideration should be given to the embodiments recited in the Summary of the Invention and the Claims.

While everything herein pertains to a naturally aspirated 3-2/2 stroke engine, there is every reason to believe that the 3-2/2 stroke engine would drastically improve the efficiency of a turbocharged engine especially at low rpm where turbochargers are least effective.

The invention claimed is:

1. A method of operating a piston driven, internal combustion engine including a piston translating in a cylinder between a top dead center position and a bottom dead center position, an intake valve to the cylinder having an open state and a closed state, and an exhaust valve from the cylinder having an open state and a closed state; the method comprising the sequential steps of:

(a) operating the intake valve to be in the open state and the exhaust valve to be in the closed state for at least a portion of an intake stroke wherein the piston moves from the top dead center position to the bottom dead center position;

(b) operating the intake valve to be in the closed state and the exhaust valve to be in the open state for at least a portion of a partial exhaust stroke wherein the piston moves from the bottom dead center position to a partial stroke position between the bottom dead center position and the top dead center;

(c) operating the intake valve to be in the closed state and the exhaust valve to be in the closed state for at least a portion of a compression stroke wherein the piston moves from the partial stroke position to the top dead center position;

(d) operating the engine to combust a fuel/air mixture in the cylinder and operating the intake valve to be in the closed state and the exhaust valve to be in the closed state for at least a portion of a power stroke wherein the piston is driven from the top dead center position to the bottom dead center position;

(e) operating the intake valve to be in the closed state and the exhaust valve to be in the open state for at least a portion of an exhaust stroke wherein the piston moves from the bottom dead center position to the top dead center position; and (f) sequentially repeating steps (a) through (e).

2. The method of claim 1 wherein:

step (a) comprises operating the intake valve to be in the open state and the exhaust valve to be in the closed state for a majority of the intake stroke;

step (b) comprises operating the intake valve to be in the closed state and the exhaust valve to be in the open state for a majority of the partial exhaust stroke;

step (c) comprises operating the intake valve to be in the closed state and the exhaust valve to be in the closed state for at least a majority of a compression stroke;

step (d) comprises operating the intake valve to be in the closed state and the exhaust valve to be in the closed state for a majority of the power stroke; and step (e) comprises operating the intake valve to be in the closed state and the exhaust valve to be in the open state for a majority of the exhaust stroke.

3. The method of claim 1 wherein at least one of:

step (a) comprises operating the intake valve to be in the open state and the exhaust valve to be in the closed state for the entire intake stroke;

step (b) comprises operating the intake valve to be in the closed state and the exhaust valve to be in the open state for the entire partial exhaust stroke;

step (c) comprises operating the intake valve to be in the closed state and the exhaust valve to be in the closed state for the entire compression stroke;

step (d) comprises operating the intake valve to be in the closed state and the exhaust valve to be in the closed state for the entire power stroke; and step (e) comprises operating the intake valve to be in the closed state and the exhaust valve to be in the open state for the entire exhaust stroke.

4. The method of claim 1 wherein the engine is operated with the piston connected by a crank to a crankshaft that rotates 180 degrees in response to the piston moving from the top dead center position to the bottom dead center position and that rotates another 180 degrees in response to the piston moving from the bottom dead center position to the top dead center position, and wherein:

step (b) comprises operating the intake valve to be in the closed state and the exhaust valve to be in the open state during less than 90 degrees of crankshaft rotation; and step (c) comprises operating the intake valve to be in the closed state and the exhaust valve to be in the closed state during more than 90 degrees of crankshaft rotation.

5. The method of claim 4 wherein:

step (b) comprises operating the intake valve to be in the closed state and the exhaust valve to be in the open state during 60 to 70 degrees of crankshaft rotation; and step (c) comprises operating the intake valve to be in the closed state and the exhaust valve to be in the closed state during 110 to 120 degrees of crankshaft rotation.

6. The method of claim 1 further comprising the step of throttling an air flow to the intake valve during step (a) to control an operating speed of the engine, with the air flow being throttled to a greater extent at low operating speeds and to a lesser extent at high operating speeds.

7. A method of operating a piston driven, internal combustion engine including a piston translating in a cylinder between a top dead center position and a bottom dead center position, an intake valve to the cylinder having an open state and a closed state, and an exhaust valve from the cylinder having an open state and a closed state, the piston connected by a crank to a crankshaft that rotates 180 degrees in response to the piston moving from the top dead center position to the bottom dead center position and that rotates another 180 degrees in response to the piston moving from the bottom dead center position to the top dead center position; the method comprising the sequential steps of:

(a) operating the intake valve to be in the open state and the exhaust valve to be in the closed state for at least part of the 180 degrees of crankshaft rotation as the piston move from the top dead center position to the bottom dead center position during an intake stroke of the piston;

(b) operating the intake valve to be in the closed state and the exhaust valve to be in the open state during less than 90 degrees of crankshaft rotation as the piston moves from the bottom dead center position to a partial stroke position between the bottom dead center position and the top dead center position during a partial exhaust stroke;

(c) operating the intake valve to be in the closed state and the exhaust valve to be in the closed state during more than 90 degrees of crankshaft rotation as the piston moves from the partial stroke position to the top dead center position during a compression stroke;

(d) operating the engine to combust a fuel/air mixture in the cylinder and operating the intake valve to be in the closed state and the exhaust valve to be in the closed state for at least part of the 180 degrees of crankshaft rotation as the piston is driven from the top dead center position to the bottom dead center position during a power stroke;

(e) operating the intake valve to be in the closed state and the exhaust valve to be in the open state for at least part of the 180 degrees of crankshaft rotation as the piston moves from the bottom dead center position to the top dead center position during an exhaust stroke; and (f) sequentially repeating steps (a) through (e).

8. The method of claim 7 wherein:

step (a) comprises operating the intake valve to be in the open state and the exhaust valve to be in the closed state for a majority of the 180 degrees of crankshaft rotation as the piston move from the top dead center position to the bottom dead center position during the intake stroke of the piston;

step (b) comprises operating the intake valve to be in the closed state and the exhaust valve to be in the open state during 60 to 70 degrees of crankshaft rotation as the piston moves from the bottom dead center position to a partial stroke position between the bottom dead center position and the top dead center position during the partial exhaust stroke;

step (c) comprises operating the intake valve to be in the closed state and the exhaust valve to be in the closed state during 110 to 120 degrees of crankshaft rotation as the piston moves from the partial stroke position to the top dead center position during the compression stroke;

step (d) comprises operating the intake valve to be in the closed state and the exhaust valve to be in the closed state for a majority of the 180 degrees of crankshaft rotation as the piston is driven from the top dead center position to the bottom dead center position during the power stroke; and step (e) comprises operating the intake valve to be in the closed state and the exhaust valve to be in the open state for a majority of the 180 degrees of crankshaft rotation as the piston moves from the bottom dead center position to the top dead center position during the exhaust stroke.

9. A method of operating a piston driven, internal combustion engine including a piston translating in a cylinder, an intake valve to the cylinder having an open state and a closed state, and an exhaust valve from the cylinder having an open state and a closed state, the piston having an intake stroke with an intake stroke length LI wherein air is drawn into the cylinder through the intake valve with the intake valve in the open state, a compression stroke with a compression stroke length LC wherein air within the cylinder is compressed, a power stroke with a power stroke length LP wherein the piston transfers power generated by a combustion of the compressed air with a fuel in the cylinder, and an exhaust stroke length LE wherein products of the combustion are forced from the cylinder through the exhaust valve with the exhaust valve in the open state; the method comprises operating the inlet and outlet valves of the engine so that the piston has a partial exhaust stroke between the intake stroke and the compression stroke, with a partial exhaust stroke length LPE, wherein the intake valve is in the closed state and the exhaust valve is in the open state.

10. The method of claim 9 wherein the engine is operated so that the power stroke length LP is 20 to 30 percent longer than the compression stroke length LC.

11. The method of claim 9 wherein the intake valve and the exhaust valve are operated to the closed states while the piston translates over the compression stroke length LC.

12. The method of claim 11 wherein the intake valve and exhaust valve are operated so that both the exhaust stroke length LE and the intake stroke length LI are approximately the same length as the power stroke length LP, with the intake valve being in the closed state and the exhaust valve being in the open state while the piston translates over the exhaust stroke length LE, and the intake valve being in the open state and the exhaust valve being in the closed state while the piston translates over the intake stroke length LI.

13. The method of claim 9 wherein the intake and exhaust valves are operated so that the partial exhaust stroke length LPE is less than the compression stroke length LC.

14. An internal combustion engine comprising:

a piston mounted for translation in a cylinder between a top dead center position and a bottom dead center position;

an intake valve to the cylinder, the intake valve having an open state and a closed state;

an exhaust valve from cylinder, the exhaust valve having an open state and a closed state;

and wherein the engine is configured to automatically operate the intake and the exhaust valves to sequentially achieve:

(a) an intake stroke wherein the piston moves from the top dead center position to the bottom dead center position with the intake valve in the open state and the exhaust valve in the closed state for at least a portion of the intake stroke;

(b) a partial exhaust stroke wherein the piston moves from the bottom dead center position to a partial stroke position between the bottom dead center position and the top dead center position with the intake valve in the closed state and the exhaust valve in the open state for at least a portion of the partial exhaust stroke;

(c) a compression stroke wherein the piston moves from the partial stroke position to the top dead center position with the intake valve in the closed state and the exhaust valve in the closed state for at least a portion of the compression stroke;

(d) a power stroke wherein the piston is driven from the top dead center position to the bottom dead center position following a combustion of a fuel/air mixture in the cylinder, with the intake valve in the closed state and the exhaust valve in the closed state for at least a portion of the power stroke; and (e) an exhaust stroke wherein the piston moves from the bottom dead center position to the top dead center position with the intake valve in the closed state and the exhaust valve in the open state for at least a portion of the exhaust stroke.

15. The internal combustion engine of claim 14 further comprising first and second exhaust valve cam shafts, the first exhaust valve cam shaft configured to operate the exhaust valve to the open state during the exhaust stroke and the second exhaust valve cam shaft configured to operate the exhaust valve to the open state during the partial exhaust stroke.

16. The internal combustion engine of claim 15 further comprising a rocker arm having a first surface in operable engagement with a first cam on the first exhaust valve cam shaft, a second surface in operable engagement with a second cam on the second exhaust cam shaft, and a third surface that transfers opening forces to the exhaust valve.

17. The internal combustion engine of claim 14 further comprising an exhaust valve cam shaft carrying an exhaust valve cam having a surface configured to transfer opening forces to the exhaust valve during the exhaust stroke and the partial exhaust stroke.

18. The internal combustion engine of claim 14 further comprising an exhaust valve solenoid configured to operate the exhaust valve to the open and closed states as required for each of the strokes in response to an electrical signal.

19. The internal combustion engine of claim 14 wherein the engine is configured to automatically operate the intake and the exhaust valves to actuate:

(a) the intake valve in the open state and the exhaust valve in the closed state for a majority of the intake stroke;

(b) the intake valve in the closed state and the exhaust valve in the open state for a majority of the partial exhaust stroke;

(c) the intake valve in the closed state and the exhaust valve in the closed state for a majority of the compression stroke;

(d) the intake valve in the closed state and the exhaust valve in the closed state for a majority of the power stroke; and (e) the intake valve in the closed state and the exhaust valve in the open state for a majority of the exhaust stroke.

20. The internal combustion engine of claim 14 wherein the engine is configured to automatically operate the intake and the exhaust valves to actuate:

(a) the intake valve in the open state and the exhaust valve in the closed state for the entire intake stroke;

(b) the intake valve in the closed state and the exhaust valve in the open state for the entire partial exhaust stroke;

(c) the intake valve in the closed state and the exhaust valve in the closed state for the entire compression stroke;

(d) the intake valve in the closed state and the exhaust valve in the closed state for the entire power stroke; and (e) the intake valve in the closed state and the exhaust valve in the open state for the entire exhaust stroke.

* * * * *